US010502012B2

(12) United States Patent
Zakharia et al.

(10) Patent No.: US 10,502,012 B2
(45) Date of Patent: Dec. 10, 2019

(54) PUSH TO RELEASE C-RING SLIP RETENTION SYSTEM

(71) Applicant: Dril-Quip, Inc., Houston, TX (US)

(72) Inventors: Steven M. Zakharia, Houston, TX (US); Curtis W. Payne, Richmond, TX (US); Frank D. Kalb, Cypress, TX (US)

(73) Assignee: Dril-Quip, Inc., Houston, TX (US)

( * ) Notice: Subject to any disclaimer, the term of this patent is extended or adjusted under 35 U.S.C. 154(b) by 135 days.

(21) Appl. No.: 15/838,775

(22) Filed: Dec. 12, 2017

(65) Prior Publication Data

US 2019/0178044 A1 Jun. 13, 2019

(51) Int. Cl.

| | |
|---|---|
| ***E21B 23/01*** | (2006.01) |
| ***E21B 43/10*** | (2006.01) |
| ***E21B 33/04*** | (2006.01) |

(52) U.S. Cl.

CPC ..... *E21B 23/01* (2013.01); *E21B 33/04* (2013.01); *E21B 43/10* (2013.01); *E21B 43/108* (2013.01)

(58) Field of Classification Search

CPC ..... E21B 23/01; E21B 43/10; E21B 33/04; E21B 33/0422; E21B 43/108

See application file for complete search history.

(56) References Cited

U.S. PATENT DOCUMENTS

| | | | | |
|---|---|---|---|---|
| 4,497,368 | A | 2/1985 | Baugh | |
| 6,761,221 | B1 * | 7/2004 | Yokley | E21B 23/01 166/118 |
| 8,511,376 | B2 * | 8/2013 | Yokley | E21B 23/01 166/216 |
| 9,938,787 | B2 * | 4/2018 | Zakharia | E21B 33/04 |
| 2003/0183396 | A1 * | 10/2003 | Adams | E21B 23/01 166/382 |
| 2007/0251704 | A1 * | 11/2007 | Reimert | E21B 43/10 166/382 |
| 2017/0226815 | A1 | 8/2017 | Zakharia et al. | |

FOREIGN PATENT DOCUMENTS

| | | | |
|---|---|---|---|
| GB | 2245624 | A | 1/1992 |
| WO | 2014065814 | A1 | 5/2014 |

OTHER PUBLICATIONS

International Search Report and Written Opinion issued in related PCT application No. PCT/US2018/063962, dated Mar. 29, 2019 (14 pages).

* cited by examiner

*Primary Examiner* — Michael R Wills, III
(74) *Attorney, Agent, or Firm* — Baker Botts L.L.P.

(57) ABSTRACT

An improved c-ring slip retention system and method for extraction of the c-ring slip are provided. The c-ring slip retention system may use a lip portion of a retention sleeve to hold the c-ring slip against a liner hanger body. The c-ring slip may have a multi-load shoulder profile that interfaces directly with a complementary profile formed in the liner hanger body. The disclosed retention system prevents the c-ring slip from being prematurely extracted from a liner hanger body while the liner hanger is lowered through a borehole. The c-ring slip retention system may include a first retention mechanism and a second retention mechanism used to secure the retention sleeve to the liner hanger body. A single actuation of at least one setting segment in an axial direction may disengage both retention mechanisms, move the retention sleeve axially relative to the liner hanger body, and extract the c-ring slip.

20 Claims, 6 Drawing Sheets

PUSH TO RELEASE C-RING SLIP RETENTION SYSTEM

TECHNICAL FIELD

The present disclosure relates generally to liner hangers and, more particularly, to a push to release c-ring slip retention system for use in a liner hanger.

BACKGROUND

When drilling a well, a borehole is typically drilled from the earth's surface to a selected depth and a string of casing is suspended and then cemented in place within the borehole. A drill bit is then passed through the initial cased borehole and is used to drill a smaller diameter borehole to an even greater depth. A smaller diameter casing is then suspended and cemented in place within the new borehole. This is repeated until a plurality of concentric casings are suspended and cemented within the well to a depth which causes the well to extend through one or more hydrocarbon producing formations.

Rather than suspending a concentric casing from the bottom of the borehole to the surface, a liner is often suspended adjacent to the lower end of the previously suspended casing, or from a previously suspended and cemented liner, so as to extend the liner from the previously set casing or liner to the bottom of the new borehole. A liner is defined as casing that is not run to the surface. A liner hanger is used to suspend the liner within the lower end of the previously set casing or liner.

A running and setting tool disposed on the lower end of a work string may be releasably connected to the liner hanger, which is attached to the top of the liner. The work string lowers the liner hanger and liner into the open borehole until the liner hanger is adjacent the lower end of the previously set casing or liner, with the lower end of the liner typically slightly above the bottom of the open borehole. When the liner reaches the desired location relative to the bottom of the open borehole and the previously set casing or liner, a setting mechanism is conventionally actuated to move an anchoring element (e.g., slips) on the liner hanger from a compressed position to an expanded position and into engagement with the previously set casing or liner. Thereafter, when a downward force is applied to the anchoring body, the anchoring element is deployed to set and support the liner.

The liner hanger anchoring element can include a radially expandable and contractable c-ring with slip teeth formed about its outer and inner edge and a frustoconical tapered surface for supporting the liner within the previously set casing or liner. Typically, the c-ring slip (or anchoring body) is held in a compressed position within a recess in the body of the liner hanger while the liner hanger is lowered through the borehole. The c-ring slip is then moved out of the recess in the body of the liner hanger, and into its expanded position.

Unfortunately, the c-ring slip can sometimes become dislodged from the recess in the liner hanger body while the liner hanger is being lowered through the borehole, thereby unintentionally expanding the anchoring element before the liner hanger is ready to be set. This premature expansion of the anchoring element can cause undesirable delays, since the liner hanger assembly must be removed from the wellbore and the anchoring element reset.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
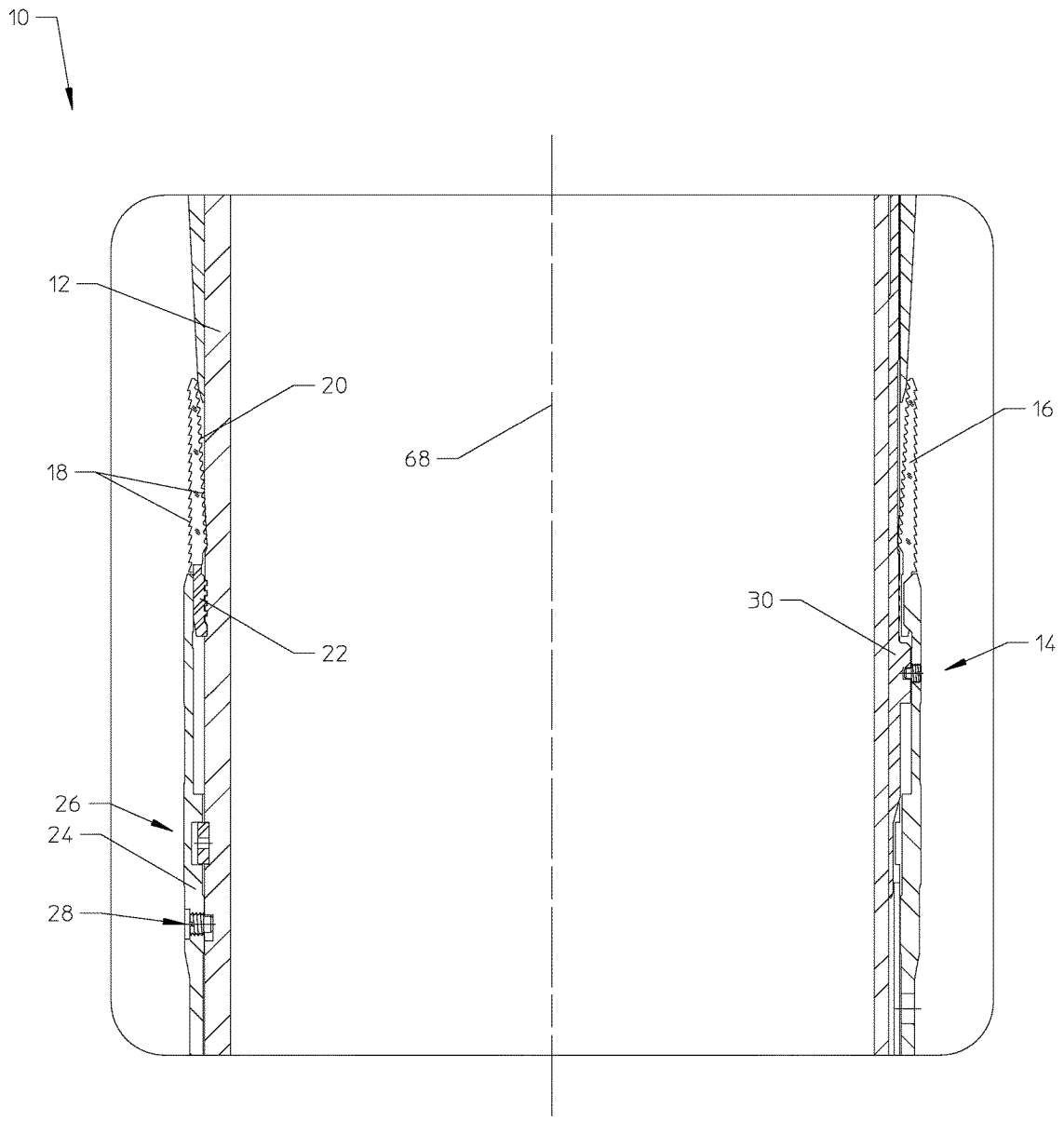
FIG. 1 is a cutaway view of a liner hanger assembly having a c-ring slip retained in a push to release c-ring slip retention system, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to a liner hanger with a push to release c-ring slip retention system and associated method for retaining and extracting the c-ring slip to set the liner hanger.

Liner hangers typically retain a c-ring slip in a compressed position under a lip of the liner hanger body as the liner hanger is being lowered downhole. Once the liner hanger reaches a desired location within a previously set casing or liner, existing systems often utilize tie-bars to remove the c-ring slip from the lip to set the liner hanger. Unfortunately, such tie-bars are susceptible to buckling failure modes when impact forces act on the c-ring slip. In addition, the c-ring slip can sometimes become dislodged from the lip in the liner hanger body while the liner hanger is being lowered through the borehole, thereby prematurely and unintentionally releasing the slip or anchoring element.

The disclosed embodiments address the deficiencies of previous liner hanger designs by providing an improved c-ring slip retention system, which allows for a fully supported c-ring slip. The c-ring slip retention system may include a retention sleeve secured to the liner hanger body via redundant primary and secondary locking (or retention) features. The retention sleeve is fixed over the outwardly biased c-ring slip to maintain the c-ring slip in engagement against the liner hanger body. An outer wall of the liner hanger body and the c-ring slip may be constructed with specifically keyed profiles that enable a tight fit and distribution of impact forces from the c-ring slip to the liner hanger. The c-ring slip may be directly locked into this portion of the liner hanger body via a multi-load shoulder. The disclosed retention system prevents the c-ring slip from prematurely dislodging from the liner hanger body while the liner hanger is being lowered through a borehole.

In the disclosed liner hanger system and method, the retention sleeve may be unlocked from the liner hanger body and axially displaced from over the c-ring slip, allowing the c-ring slip to expand and set the liner hanger. To release the c-ring slip, one or more setting segments are stroked axially downward to disengage both locking mechanisms and actuate the retention sleeve relative to the liner hanger body. The c-ring slip retention system may be a push to release system in that the axial direction in which the setting segments are stroked is the same downhole direction in which the liner hanger has previously been lowered with the c-ring slip.

The disclosed c-ring slip retention system and method may facilitate a more reliable liner hanger that prevents premature release of the c-ring slip or anchoring element. The retention system keeps the c-ring slip in a desired axial and radial position prior to extraction. The system enables effective transfer of large axial/radial forces that might act on the c-ring slip while the liner hanger is being lowered downhole, while facilitating extraction of the c-ring slip via the application of a relatively small actuation force. The disclosed c-ring slip retention system may increase the downhole retention capacity of liner hangers and improve the reliability of the governing liner hanger setting equipment.

Turning now to the drawings, FIG. 1 is a cutaway view of a liner hanger 10 having a push to release c-ring slip, in accordance with an embodiment of the present disclosure. The liner hanger 10 includes a liner hanger body 12 and an improved c-ring slip retention system 14 for retaining a c-ring slip 16 in a locked/compressed position within the liner hanger 10. It is desirable to maintain the c-ring slip 16 in this locked/compressed position while the liner hanger 10 is being lowered down a borehole, to avoid premature setting of the liner hanger 10. The c-ring slip 16 is a radially expandable and contractable c-ring having slip teeth 18 formed about its outer edge and its inner edge, and a frustoconical tapered surface 20 for supporting the liner hanger 10 within a previously set casing or liner (not shown).

In the illustrated embodiment, the c-ring slip retention system 14 may include a multi-load shoulder profile 22 formed on the c-ring slip 16 for connecting the c-ring slip 16 directly to the liner hanger body 12. The multi-load shoulder profile 22 ties the outwardly biased c-ring slip 16 directly to the liner hanger body 12 so that any axial loading to the c-ring slip 16 while running in hole is transmitted directly to the liner hanger body 12, preventing premature deployment of the c-ring slip 16. The c-ring slip retention system 14 may also include a retention sleeve 24 coupled to the liner hanger body 12. The retention sleeve 24 provides radial support to the outwardly biased c-ring slip 16 and ensures maximum contact with the multi-load shoulder 22. The retention sleeve 24 may be locked into the liner hanger body 12 using a primary retention mechanism (primary mechanical lock) 26 and a secondary retention mechanism (secondary shear mechanism) 28. The c-ring slip retention system 14 may further include one or more setting segments 30 that may be used to disengage the primary mechanical lock 26 and the secondary shear mechanism 28 to set the c-ring slip 16.

Figure 2:
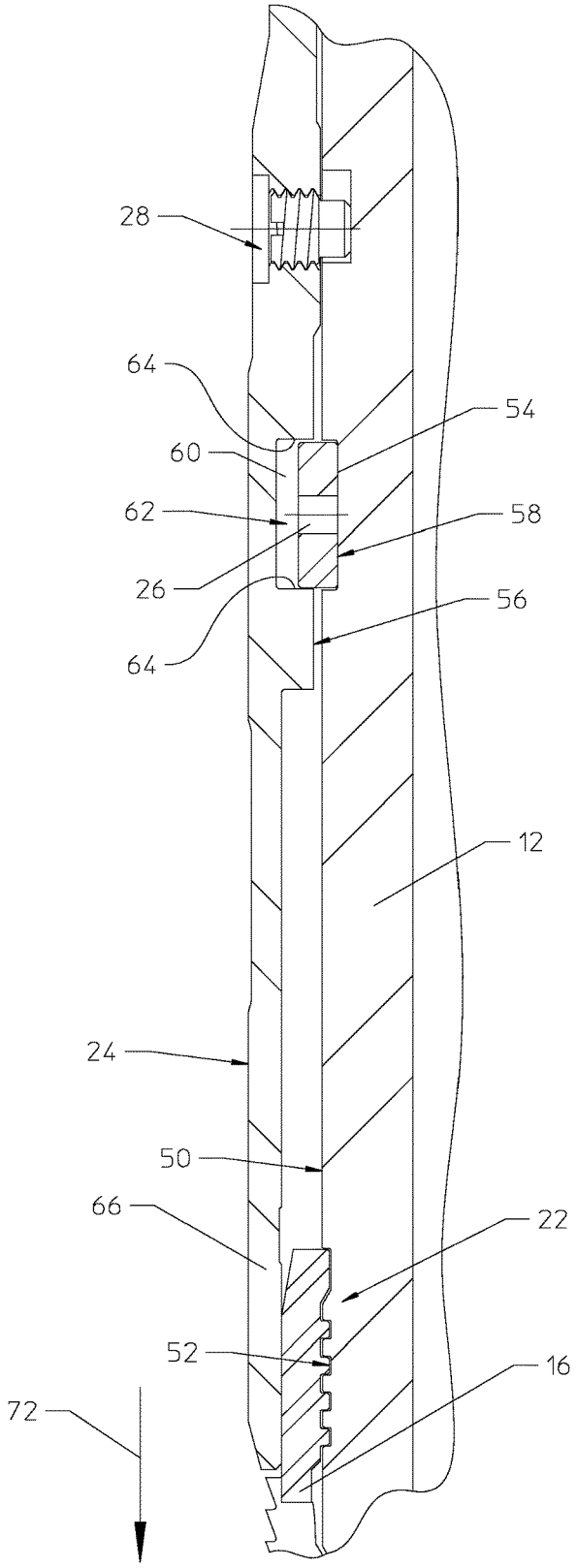
FIG. 2 is a cutaway view of a slip retention system used in the liner hanger assembly of FIG. 1, in accordance with an embodiment of the present disclosure.

A more detailed view of the c-ring slip retention system 14 is illustrated in FIG. 2. The illustrated c-ring slip retention system 14 may be a two-part slip retention system. The first part of the c-ring slip retention system 14 is the interface between the c-ring slip 16 and the liner hanger body 12. Specifically, the c-ring slip 16 may include the multi-load shoulder 22 in the form of a profile facing a radially outer wall 50 of the liner hanger body 12. The outer wall 50 of the liner hanger body 12 may include a complementary profile 52 for receiving the multi-load shoulder profile 22 of the c-ring slip 16 and thereby receiving the c-ring slip 16. The profiles 22 and 52 may be specifically keyed to provide a precision fit between the c-ring slip 16 and the liner hanger body 12. Thus, the multi-load shoulder 22 ties the c-ring slip 16 directly to the liner hanger body 12. In this configuration, any axial loads or impact loads experienced by the c-ring slip 16 (e.g., while the liner and liner hanger are being lowered through a borehole) may be directly transmitted into the liner hanger body 12 via the multi-load shoulder profile 22. The multi-load shoulder profile 22 may span the circumference of the c-ring slip 16, so as to provide a relatively large area of interference between the c-ring slip 16 and the liner hanger body 12.

The second part of the c-ring slip retention system 14 includes the retention sleeve 24 and its associated retention mechanisms 26 and 28 for locking the retention sleeve 24 to the liner hanger body 12. The retention sleeve 24 may be disposed around the outer wall 50 of the liner hanger body 12. The retention sleeve 24 may be directly secured to the liner hanger body 12 at a location axially displaced from the interface of the liner hanger body 12 and the c-ring slip 16. The retention sleeve 24 is secured to the liner hanger body 12 via the primary and secondary retention mechanisms 26 and 28.

The primary mechanical lock 26 may include a lock ring positioned between the retention sleeve 24 and the liner hanger body 12. The outer wall 50 of the liner hanger body 12 may include an indentation 54 formed therein to receive a radially inner portion 58 of the lock ring 26. An inner wall 56 of the retention sleeve 24 may similarly include an indentation 60 formed therein to receive a radially outer portion 62 of the lock ring 26. The lock ring 26 may be generally C-shaped and biased to a radially inward direction when positioned around the liner hanger body 12. The radially inner portion 58 of the lock ring 26 may be in full engagement with the indentation 54 formed in the liner hanger body 12, while the radially outer portion 62 of the lock ring 26 may be in engagement with opposing shoulders 64 of the retention sleeve indentation 60. As such, a space is available in a radially external direction from the lock ring 26 to allow for further expansion of the lock ring 26 toward the retention sleeve 24. It should be noted that other types and arrangements of locking mechanisms may be used for the primary lock 26 between the liner hanger body 12 and the retention sleeve 24.

The secondary retention mechanism 28 may include a shearing mechanism, such as a shear screw, directly coupling the retention sleeve 24 to the liner hanger body 12. The secondary shearing mechanism 28 may include multiple such shearing mechanisms positioned at different circumferential locations about the retention sleeve 24 and coupling the retention sleeve to the liner hanger body 12. Each of the shearing mechanisms 28 may be positioned out of phase with the one or more setting segments (not shown). The secondary shearing mechanism 28 may keep the retention sleeve 24 firmly secured against the liner hanger body 12 until such time as the one or more setting segments are moved to shear the retention sleeve 24 away from the liner hanger body 12. The two retention mechanisms 26 and 28 together help to prevent movement of the retention sleeve 24 relative to the liner hanger body 12 during deployment of the liner hanger.

The retention sleeve 24 may feature a lip portion 66 disposed around part of the liner hanger body 12. The lip portion 66 of the retention sleeve 24 is not in contact with the liner hanger body 12, but instead hangs over the liner hanger body 12. The lip portion 66 defines a cavity between the retention sleeve 24 and the liner hanger body 12 for receiving and holding the c-ring slip 16 when the c-ring slip 16 is in a compressed state. The lip portion 66 extends in a direction substantially parallel to a liner hanger longitudinal axis (68, as shown in FIG. 1). The lip portion 66 of the retention sleeve 24 is fixed above the outwardly biased c-ring slip 16, thereby ensuring that the multi-load shoulder 22 on the c-ring slip 16 has maximum engagement with the liner hanger body 12. The retention sleeve 24 is axially fixed to the liner hanger body 12 with respect to the longitudinal axis (e.g., 68 of FIG. 1) of the liner hanger (e.g., 10 of FIG. 1) via the primary mechanical lock 26 and secondary shear screw 28. This arrangement allows the outwardly biased c-ring slip 16 to be mechanically locked into place against the liner hanger body 12 with full circumferential contact at the multi-load shoulder profile 22.

The c-ring slip retention system 14 may prevent the c-ring slip 16 from being pulled out of the lip portion 66 of the retention sleeve 24 if, for example, debris catches on the outer edge (e.g., slip teeth 18 of FIG. 1) of the c-ring slip 16 while the liner hanger (e.g., 10 of FIG. 1) is being lowered through a borehole. If a force of impact acts on the c-ring slip 16 (e.g., in direction 72), the force would be transmitted into the liner hanger body 12 via the keyed interlocking profiles 22 and 52. The axial force (72) may then be converted to a tension load on the liner hanger body 12. Forces on the c-ring slip 16 in a radial direction may be similarly transferred directly into the liner hanger body 12 via the multi-load shoulder profile 22. This transfer of forces within the c-ring slip retention system 14 may prevent premature release of the c-ring slip 16 from the retention sleeve 24. It should be noted that the disclosed slip retention system 14 does not utilize tiebars like conventional liner hangers. Therefore, the slip retention system 14 eliminates buckling as a failure mode by allowing the axial impact force 62 to be converted into a tension load on the liner hanger body 12.

Figure 3:
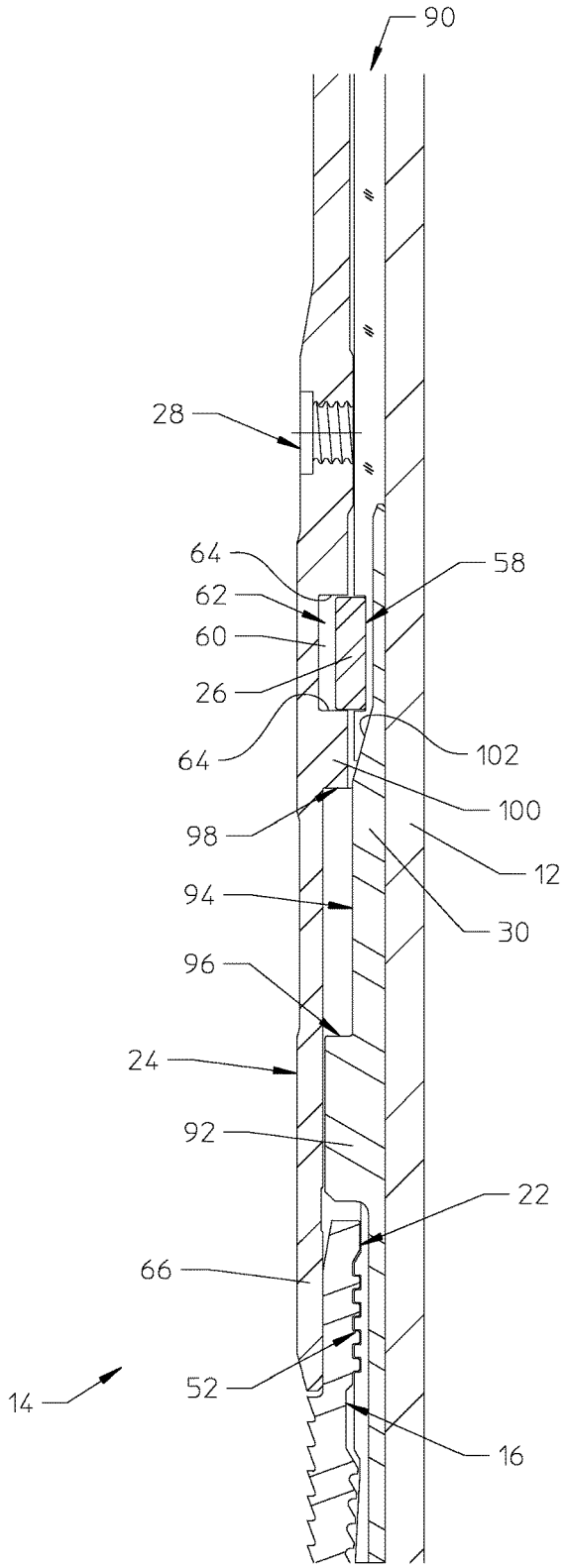
FIG. 3 is a cutaway view of the slip retention system of FIG. 1 retaining the c-ring slip in a run-in position, in accordance with an embodiment of the present disclosure.

As mentioned above, the c-ring slip retention system 14 may include one or more setting segments (e.g., 30 of FIG. 1) that are selectively actuable to unlock the retention mechanisms 26 and 28 and release the c-ring slip 16 from under the retention sleeve 24. FIG. 3 provides another detailed view of the c-ring slip retention system 14 showing one such setting segment 30. The cutaway view of the c-ring slip retention system 14 in FIG. 3 is taken from a different rotational position about the longitudinal axis (e.g., 68 of FIG. 1) as the cutaway view of FIG. 2. That is, the cutaway view of FIG. 3 is taken from the same c-ring slip retention system 14 as FIGS. 1 and 2, but out of phase from the cutaway view in FIG. 2.

As shown in FIG. 3, the setting segment 30 is shown positioned within a space or slot 90 formed in the liner hanger body 12. Multiple such setting segments 30 may be disposed about a circumference of the liner hanger body 12 and positioned within corresponding spaces or slots 90 formed in the liner hanger body 12. The spaces or slots 90 may be formed in the outer wall 50 of the liner hanger body 12, for example. In some instances, the spaces or slots 90 in the liner hanger body 12 may include dovetail slots at one end or along the entire length. The spaces or slots 90 may prevent the setting segments 30 from buckling and help resist torsion on the setting segment 30 by preventing rotational movement of the setting segment relative to the liner hanger body 12. The spaces or slots 90 formed in the liner hanger body 12 may extend axially along the entire length of the c-ring slip retention system 14 shown in FIG. 3 (e.g., from where the c-ring slip 16 is held against the liner hanger body 12 to a position beyond the primary and secondary retention mechanisms 26 and 28). As shown, the secondary shearing mechanism 28 is generally located out of phase with respect to the spaces or slots 90 formed in the liner hanger body 12, since the spaces or slots 90 in the outer wall 50 of the liner hanger body 12 do not allow for a shearable connection between the liner hanger body 12 and the retention sleeve 24 at that circumferential location.

Although not shown, in embodiments where multiple setting segments 30 are utilized, the setting segments 30 may all be secured together at an axial position away from the rest of the c-ring slip retention system 14. That way, the multiple setting segments 30 may all be stroked in an axial direction relative to the liner hanger body 12 at the same time to initiate the release of the c-ring slip 16. In some instances, a ring may be disposed around and clamped against separate setting segments 30 to hold the segments together. In other embodiments, the multiple setting segments 30 and a ring connecting the setting segments 30 together may be integrally formed as a single setting sleeve that can be actuated by pressing down on the setting sleeve. In still other embodiments, the setting segments 30 may not be attached to each other at all, but instead may each be positioned against the same piston, sleeve, or other component that is configured to contact and actuate each setting segment 30 at the same time in response to a single motion of the component.

Within the c-ring slip retention system 14, each setting segment 30 may include a projection 92 extending radially outward from a radially outer wall 94 of the setting segment 30. The projection 92 may provide a shoulder 96 at the interface between an axial end of the projection 92 and the adjacent outer wall 94. The shoulder 96 is designed to contact a complementary shoulder 98 at the interface between a radially inward projection 100 on the retention sleeve 24 and the lip portion 66 of the retention sleeve 24. The projection 92 and shoulder 96 are configured to exert a force on the retention sleeve 24 in an axial direction so as to shear the secondary shear mechanism 28 (e.g., second lock) holding the retention sleeve 24 against the liner hanger body 12.

The setting segment 30 may further include an inclined surface 102 designed to unlock the primary mechanical lock 26 in response to axial movement of the setting segment 30 relative to the liner hanger body 12. The inclined surface 102 may impart a force on the primary mechanical lock 26 in a radially outward direction in response to the axial movement of the setting segment 30. As shown, the inclined surface 102 is a portion of the outer wall 94 of the setting segment 30 that slopes radially inward as it moves axially farther from the projection 92 on the outer wall 94.

Both the primary and secondary retention mechanism 26 and 28 are engaged (i.e., locked) in FIGS. 2 and 3. These mechanisms 26 and 28 are engaged while the liner hanger and the c-ring slip 16 are being run in hole. That way, the retention mechanisms 26 and 28 keep the c-ring slip 16 from prematurely releasing before the liner hanger is positioned in a desired axial location.

A detailed description of the method for unlocking the disclosed c-ring slip retention system 14 to extract the c-ring slip 16 will now be provided. In the locked/compressed position described above with reference to FIGS. 1, 2, and 3, the c-ring slip 16 may be mechanically locked (via slip retention system 14) to prevent any axial or radial motion.

In some embodiments, a hydraulically actuated piston or other component on a liner hanger running tool may push axially in a downhole direction on the one or more setting segments 30, thereby stroking each of the setting segments 30 in an axial direction. It should be noted that the stroking the setting segments 30 in a downhole or downward axial direction relative to the liner hanger body 12 may provide a more streamlined construction and operation of the liner hanger running tool and the c-ring slip retention system.

Figure 4:
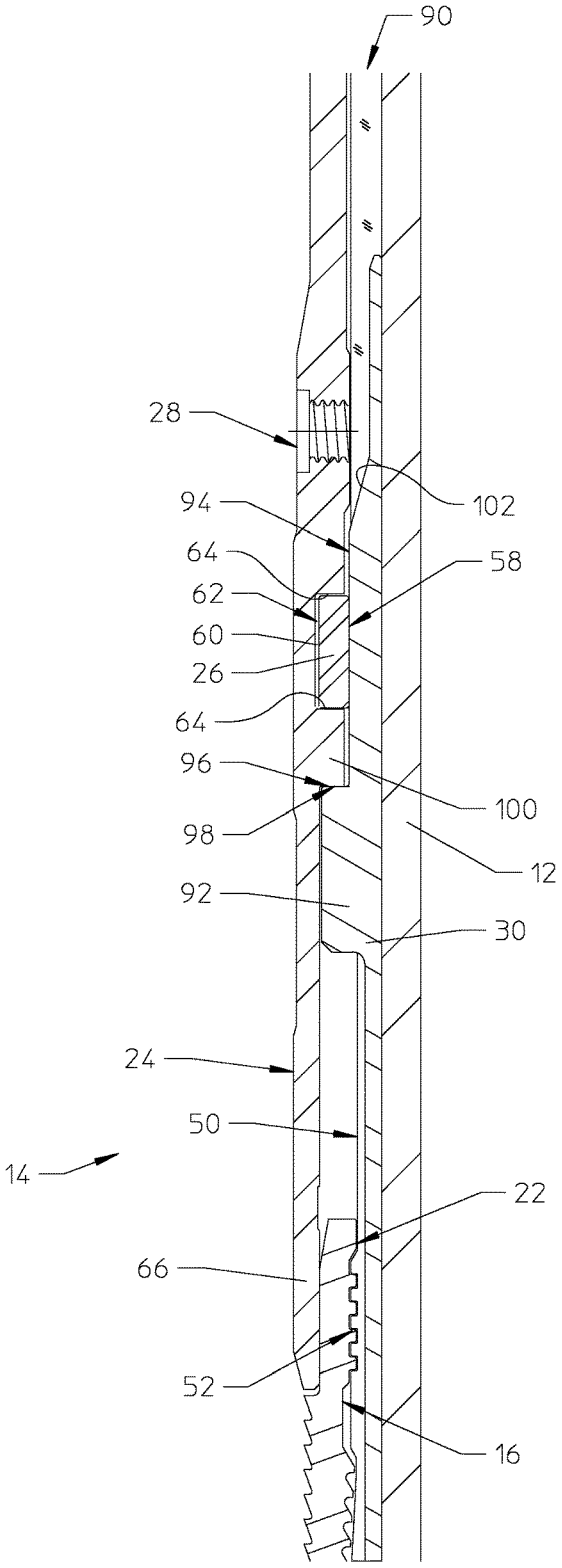
FIG. 4 is a cutaway view of the slip retention system of FIG. 1 being unlocked, in accordance with an embodiment of the present disclosure.

Actuating the setting segments 30 in the axial direction may unlock the primary mechanical lock 26. Specifically, the inclined surface 102 on each setting segment 30 may contact the primary lock ring 26 as the setting segment 30 is stroked downward, and the inclined surface 102 may impart a radial force on the lock ring 26 that flexes the lock ring 26 radially outward as the setting segment 30 is stroked downward. Eventually, the inclined surface 102 of the setting segment 30 may pass beyond the lock ring 26, at which point the lock ring 26 is moved to the radially outward position and has full contact along its radially inner surface with the outer wall 94 of the setting segment 30. Once in this position, the lock ring 26 is positioned within the space that previously existed in the retention sleeve indentation 60 between shoulders 64. In this position, the primary mechanical lock 26 is unlocked, as shown in FIG. 4.

Figure 5:
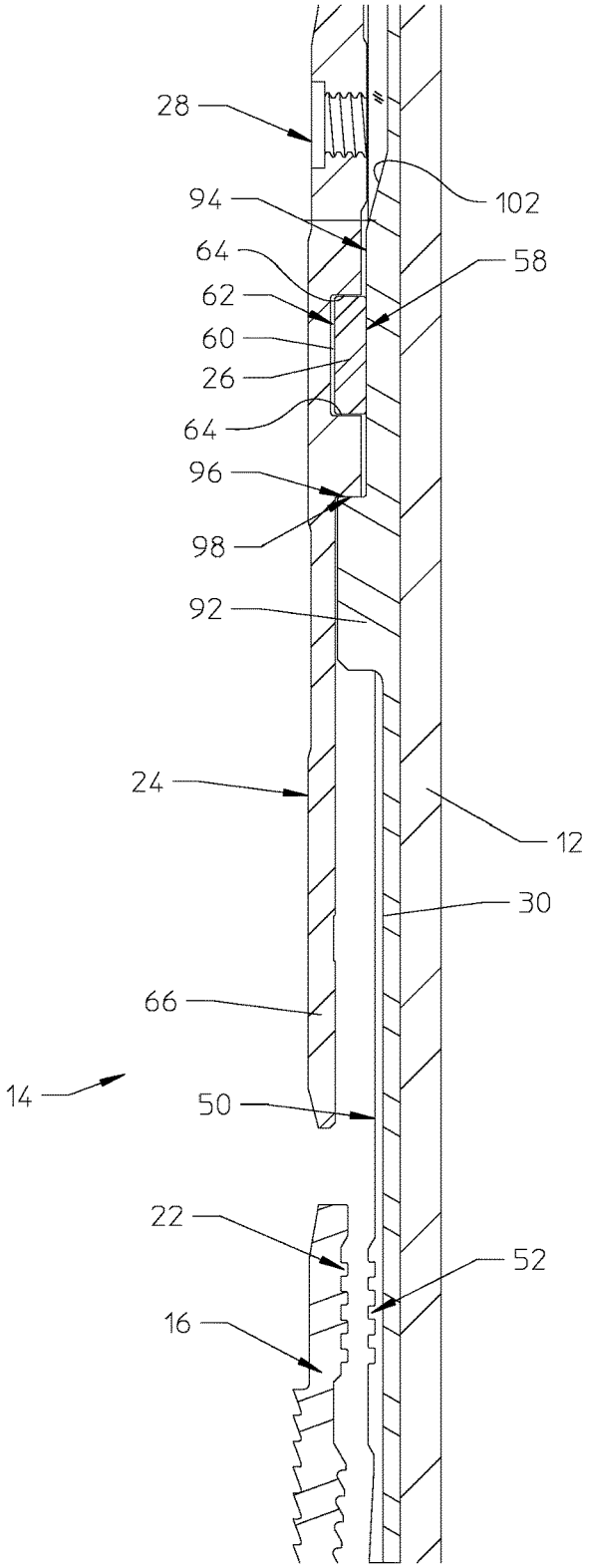
FIG. 5 is a cutaway view of the slip retention system of FIG. 1 being stroked to release the c-ring slip, in accordance with an embodiment of the present disclosure.

From here, the method may include stroking each of the setting segments 30 further in the same axial direction (i.e., downhole) until the setting segments 30 shear the one or more secondary shearing mechanisms 28. Stroking the setting segment 30 relative to the liner hanger body 12 may engage the shoulder 96 of the setting segment projection 92 with the complementary shoulder 98 of the retention sleeve projection 100. Thus, the setting segment 30 imparts an axially downward force on the retention sleeve 24. Once the downward force on the retention sleeve 24 exceeds a threshold, the force shears the secondary shearing mechanism 28 between the retention sleeve 24 and the liner hanger body 12. Thus, the setting segments 30 are stroked downward to disengage both the primary mechanical lock 26 and the secondary shearing mechanism 28. This allows the retention sleeve 24 to be displaced in the downward axial direction to uncover the outwardly biased c-ring slip 16, as shown in FIG. 5.

At this point, the lip portion 66 of the retention sleeve 24 is no longer in contact with the c-ring slip 16, and the outwardly biased c-ring slip 16 is able to expand and engage the casing. As such, the method for releasing the c-ring slip 16 generally includes stroking the setting segments 30 (e.g., via a running tool) to disengage the primary mechanical lock 26, transmitting a load through the setting segments 30 to shear the secondary retention mechanism 28, and displacing the retention sleeve 24 so that the c-ring slip 16 is uncovered and can expand outward.

Figure 6:
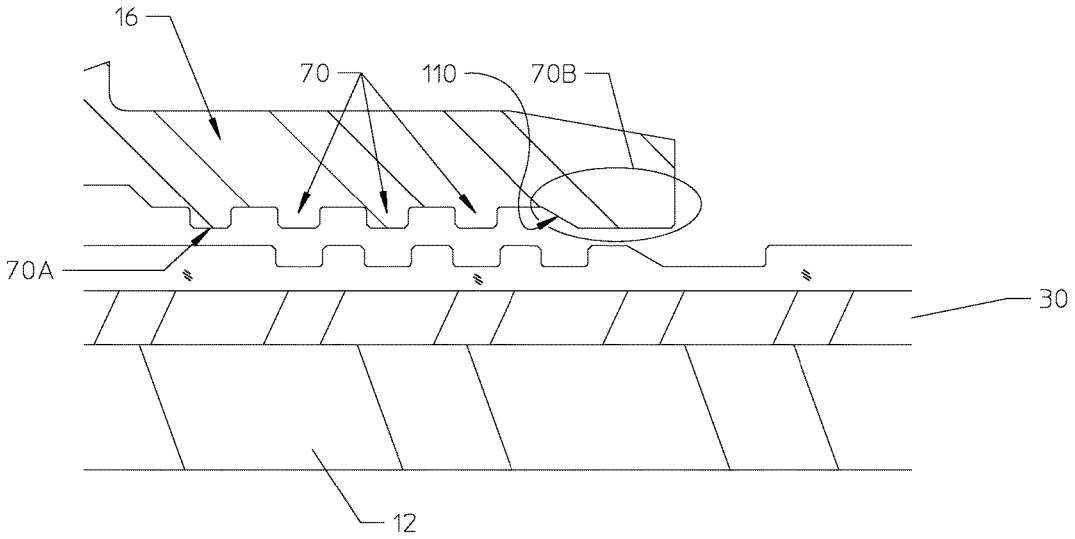
FIG. 6 is a close-up cutaway view of an engagement profile on the c-ring slip of FIG. 1, in accordance with an embodiment of the present disclosure.

FIG. 6 is a more detailed view of the multi-load shoulder profile 22 on the c-ring slip 16 and the complementary profile 52 on the liner hanger body 12. As shown, the profile 22 may include multiple shoulders 70, and the complementary profile 52 on the liner hanger body 12 may be sized to receive the corresponding shoulders 70 when the c-ring slip retention system is holding the c-ring slip 16 in contact with the liner hanger body 12. As illustrated, the multiple shoulders 70 may have different widths from each other. These "widths" may be measured in a direction parallel to the longitudinal axis (e.g., 68 of FIG. 1) of the liner hanger (e.g., 10 of FIG. 1). For example, a first (front) shoulder 70A disposed axially closer to the extended edge of the retention sleeve 24 may have a smaller width than a last (back) shoulder 70B located axially further from the extended edge of the retention sleeve 24. This arrangement may prevent the back shoulder 70B from becoming caught in the portion of the retention lip profile 56 sized to interface with the other shoulders as the c-ring slip 16 is expanded out of contact with the liner hanger body 12. In other embodiments, the two shoulders 70 may have different heights from each other to achieve a similar effect.

The back shoulder 70B of the multi-load shoulder profile 22 may feature a unique profile such as an inclined surface 110 of the shoulder 70B. This unique profile of the back shoulder 70B ensures that once the c-ring slip 16 has displaced axially out of place, it can no longer back into its locked position against the complementary profile 52.

Although five shoulders 70 are illustrated in FIG. 6, in other embodiments the interlocking profiles 22 and 52 may include any suitable number of shoulders 70. In still other embodiments, the profiles 22 and 52 may include any desirable type and number of keyed features that create a precision fit between the outer edge of the c-ring slip 16 and the outer wall of the liner hanger body 12.

The disclosed c-ring slip retention system 14 may provide a mechanical lock for handling radial as well as axial deflections on the c-ring slip 16. The system may ensure that any axial impact exerted on the c-ring slip 16 is transferred to the liner hanger body 12 via the multi-load shoulder profile 22. Both mechanical retention mechanisms 26 and 28 may be deactivated, and the c-ring slip 16 extracted from the liner hanger body 12, via a single axial movement of the one or more setting segments 30 actuated, for example, by a single hydraulic piston on a liner hanger running tool.

Although the present disclosure and its advantages have been described in detail, it should be understood that various changes, substitutions and alterations can be made herein without departing from the spirit and scope of the disclosure as defined by the following claims.

What is claimed is:

1. A c-ring slip retention system, comprising:

a liner hanger body;

a c-ring slip disposed around the liner hanger body;

a retention sleeve disposed around the liner hanger body and comprising a lip portion extending over the c-ring slip, wherein the lip portion compresses the c-ring slip into engagement with the liner hanger body;

a first retention mechanism and a second retention mechanism each directly connecting and securing the retention sleeve to the liner hanger body; and at least one setting segment disposed in a space or slot formed in the liner hanger body, wherein the setting segment is axially movable relative to the liner hanger body to deactivate the first retention mechanism and the second retention mechanism.

2. The c-ring slip retention system of claim 1, wherein the c-ring slip comprises a keyed profile, and wherein an outer wall of the liner hanger body comprises a complementary profile.

3. The c-ring slip retention system of claim 2, wherein the keyed profile comprises a front shoulder and a back shoulder extending from the c-ring slip, wherein the front and back shoulders have different widths or heights.

4. The c-ring slip retention system of claim 3, wherein the back shoulder is closer to an axial end of the c-ring slip than the front shoulder, and wherein the back shoulder has a larger width than the front shoulder.

5. The c-ring slip retention system of claim 3, wherein the back shoulder comprises an inclined surface.

6. The c-ring slip retention system of claim 1, wherein the first retention mechanism comprises an expandable lock ring.

7. The c-ring slip retention system of claim 6, wherein the liner hanger body comprises an indentation formed therein, the retention sleeve comprises an indentation formed therein, and the lock ring is disposed within one or both of the indentations.

8. The c-ring slip retention system of claim 7, wherein the setting segment comprises an inclined surface, wherein the inclined surface is configured to move the lock ring into the indentation of the retention sleeve in response to axial movement of the setting segment.

9. The c-ring slip retention system of claim 1, wherein the second retention mechanism comprises a shear screw configured to shear in response to a shear force between the retention sleeve and the liner hanger body.

10. The c-ring slip retention system of claim 9, wherein the second retention mechanism comprises a plurality of shear screws disposed circumferentially about the retention sleeve.

11. The c-ring slip retention system of claim 9, wherein the setting segment comprises a projection having a shoulder, wherein the shoulder is configured to engage a complementary shoulder on the retention sleeve and exert a shear force between the retention sleeve and the liner hanger body in response to axial movement of the setting segment.

12. A method, comprising:

holding a c-ring slip in an axial position between a liner hanger body and a retention sleeve disposed around the liner hanger body;

securing the retention sleeve to the liner hanger body via a first retention mechanism and a second retention mechanism each coupled between the retention sleeve and the liner hanger body; and axially moving at least one setting segment within a space or slot in the liner hanger body; and disengaging the first and second retention mechanisms via the setting segment in response to the axial movement of the setting segment.

13. The method of claim 12, wherein holding the c-ring slip in the axial position comprises pressing a keyed profile of the c-ring slip against a complementary profile on the liner hanger body.

14. The method of claim 12, further comprising axially moving the retention sleeve in response to disengaging the first and second retention mechanisms, and releasing the c-ring slip in response to the axial movement of the retention sleeve.

15. The method of claim 14, further comprising expanding the c-ring slip into engagement with a frustoconical tapered surface of the liner hanger body upon releasing the c-ring slip.

16. The method of claim 12, wherein disengaging the first retention mechanism comprises expanding a lock ring.

17. The method of claim 16, further comprising pressing against the lock ring via an inclined surface of the setting segment to expand the lock ring.

18. The method of claim 12, wherein disengaging the second retention mechanism comprises shearing one or more shear screws.

19. The method of claim 16, further comprising exerting a shear force between the retention sleeve and the liner hanger body via a shoulder on the setting segment engaging a shoulder on the retention sleeve.

20. The method of claim 12, further comprising axially moving the at least one setting segment via a hydraulic piston on a liner hanger running tool.

* * * * *